US011178899B2

(12) United States Patent
Schaller et al.

(10) Patent No.: US 11,178,899 B2
(45) Date of Patent: Nov. 23, 2021

(54) PRODUCING AN AEROSOL-FORMING COMPOSITION

(71) Applicant: Philip Morris Products S.A., Neuchatel (CH)

(72) Inventors: Jean-Pierre Schaller, Geneva (CH); Markus Klein, Ligerz (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/736,366

(22) PCT Filed: Jun. 17, 2016

(86) PCT No.: PCT/EP2016/064079
§ 371 (c)(1),
(2) Date: Dec. 14, 2017

(87) PCT Pub. No.: WO2017/009002
PCT Pub. Date: Jan. 19, 2017

(65) Prior Publication Data

US 2018/0153208 A1 Jun. 7, 2018

(30) Foreign Application Priority Data

Jul. 13, 2015 (EP) ..... 15176520

(51) Int. Cl.
*A24B 15/167* (2020.01)
*B65B 3/04* (2006.01)
(Continued)

(52) U.S. Cl.
CPC ..... *A24B 15/167* (2016.11); *A24F 40/00* (2020.01); *A24F 40/80* (2020.01); *B65B 3/04* (2013.01); *A24F 40/10* (2020.01); *A24F 40/70* (2020.01)

(58) Field of Classification Search
CPC ..... A24B 15/167; A24F 47/008; B65B 3/04; A24C 5/3406
See application file for complete search history.

(56) References Cited

U.S. PATENT DOCUMENTS 5,060,671 A 10/1991 Counts et al.
5,348,027 A 9/1994 Barnes et al.
(Continued)

FOREIGN PATENT DOCUMENTS

CN 1656010 A 8/2005
CN 103813726 A 5/2014
(Continued)

OTHER PUBLICATIONS

"Smoke Corner 24/7: Distributeur automatique e-liquids", Retrieved from the internet: http://www.smoke-corner.fr, Retrieved on Mar. 15, 2018, 1 page (with English translation).
(Continued)

*Primary Examiner* — Francisco W Tschen
*Assistant Examiner* — Guy F Mongelli
(74) *Attorney, Agent, or Firm* — Oblon, McClelland, Maier & Neustadt, L.L.P.

(57) ABSTRACT

There is provided a machine for producing an aerosol-forming composition for an aerosol-generating system, the machine including a plurality of reservoirs configured to contain components of an aerosol-forming composition; a mixing mechanism in communication with the plurality of reservoirs; a controller connected to, and configured to control, the mixing mechanism; a user interface connected to the controller for a user to operate the machine, the mixing mechanism being configured to mix selective quantities of components from the plurality of reservoirs according to specified ratios to create an aerosol-forming composition; a testing mechanism including a heater assembly configured
(Continued)

to vaporize a test sample to form an aerosol, and at least one outlet configured to deliver the aerosol to the user; and a transfer mechanism configured to deliver the test sample to the testing mechanism. There is also provided a machine and process for producing and delivering the test sample.

15 Claims, 7 Drawing Sheets

(51) Int. Cl.

| | |
|---|---|
| ***A24F 40/80*** | (2020.01) |
| ***A24F 40/00*** | (2020.01) |
| ***A24F 40/10*** | (2020.01) |
| ***A24F 40/70*** | (2020.01) |

(56) References Cited

U.S. PATENT DOCUMENTS

| | | | | |
|---|---|---|---|---|
| 5,388,594 | A | 2/1995 | Counts et al. | |
| 5,474,092 | A | 12/1995 | Moser et al. | |
| 5,505,214 | A | 4/1996 | Collins et al. | |
| 5,591,368 | A | 1/1997 | Fleischhauer et al. | |
| 5,666,977 | A * | 9/1997 | Higgins | A24F 40/48 131/194 |
| 2001/0025855 | A1* | 10/2001 | Leboucher | B65B 3/04 220/839 |
| 2002/0106813 | A1* | 8/2002 | Smith | B01J 19/0046 436/180 |
| 2011/0103778 | A1* | 5/2011 | Batts | F22B 27/16 392/405 |
| 2011/0236960 | A1* | 9/2011 | Bird | C12Q 1/686 435/283.1 |
| 2014/0102048 | A1* | 4/2014 | Arnitz | A61M 5/008 53/467 |
| 2014/0130796 | A1* | 5/2014 | Liu | A24F 40/44 128/202.21 |
| 2014/0199283 | A1* | 7/2014 | Zhao | A61J 1/00 424/94.3 |
| 2014/0300480 | A1 | 10/2014 | Xiang | |
| 2014/0339213 | A1* | 11/2014 | Bao | A61M 11/042 219/209 |
| 2014/0349073 | A1* | 11/2014 | Sun | H01J 37/32807 428/148 |
| 2015/0083146 | A1* | 3/2015 | Goldman | A24B 15/10 131/329 |
| 2015/0128968 | A1* | 5/2015 | Chapman | A24F 47/008 131/329 |
| 2015/0136130 | A1* | 5/2015 | DeHaan | A61K 9/1617 128/203.15 |
| 2015/0144145 | A1 | 5/2015 | Chang et al. | |
| 2015/0181936 | A1* | 7/2015 | Lyubomirskiy | A24F 47/008 219/553 |
| 2015/0191266 | A1 | 7/2015 | Holmes et al. | |
| 2015/0245667 | A1* | 9/2015 | Memari | A24F 40/50 131/329 |
| 2015/0289565 | A1* | 10/2015 | Cadieux | A24F 40/70 131/328 |
| 2016/0106144 | A1* | 4/2016 | Muehlbauer | A24B 15/26 131/298 |
| 2016/0213064 | A1 | 7/2016 | Boldrini | |
| 2016/0331026 | A1* | 11/2016 | Cameron | A24F 40/30 |
| 2017/0000191 | A1 | 1/2017 | Rivero | |
| 2018/0020737 | A1* | 1/2018 | Mironov | H05B 3/44 131/329 |

FOREIGN PATENT DOCUMENTS

| | | | |
|---|---|---|---|
| CN | 104000302 | A | 8/2014 |
| CN | 204 108 632 | U | 1/2015 |
| EP | 0 295 122 | A2 | 12/1988 |
| EP | 0 358 002 | A2 | 3/1990 |
| EP | 1 618 803 | A1 | 1/2006 |
| EP | 1 736 065 | A1 | 12/2006 |
| EP | 201290809 | A1 | 2/2013 |
| ES | 2 526 106 | A2 | 1/2015 |
| JP | 2001-161819 | A | 6/2001 |
| UZ | 2 817 | C | 10/2005 |
| WO | WO 2004/043175 | A1 | 5/2004 |
| WO | WO 2007/131449 | A1 | 11/2007 |
| WO | WO 2013/128176 | A1 | 9/2013 |
| WO | WO 2015/028815 | A1 | 3/2015 |
| WO | WO 2015/040568 | A1 | 3/2015 |
| WO | WO 2015/103609 | A1 | 7/2015 |
| WO | WO-2015103609 | A1 * | 7/2015 ..... A24F 47/008 |

OTHER PUBLICATIONS

"Automatic e-Cigarette Cartomizer E-Cig Filing with e-liquid electron . . . ", Automated Machine Technologies, Inc., Retrieved from the internet: http://www.amtliquidfilling.com/e-Cig.html, 2008, 3 pages.

International Search Report and Written Opinion dated Sep. 26, 2016 in PCT/EP2016/064079, filed Jun. 17, 2016.

Decision to Grant dated Aug. 30, 2019 in Russian Patent Application No. 2017145398 (with English translation), citing documents AO and AP therein, 17 pages.

Japanese Office Action dated Aug. 11, 2020 in corresponding Japanese Patent Application No. 2017-566674 (with English translation), citing documents AO and AP therein, 7 pages.

Chinese Office Action and Search Report dated Mar. 16, 2020 in corresponding Chinese Application No. 201680036351.5 (w/ English Translation), citing documents AA and AO-AQ therein (13 pages).

Japanese Office Action dated Jul. 5, 2021 in Japanese Patent Application No. 2017-566674 (with English translation), citing document AA therein, 5 pages.

* cited by examiner

PRODUCING AN AEROSOL-FORMING COMPOSITION

The present invention relates to a machine and method for producing an aerosol-forming composition for use in an aerosol-generating system, for example an electrically operated aerosol-generating system. In particular, aspects of the present invention relate to a machine and method for producing an aerosol-forming composition for use in an electrically operated aerosol-generating system.

One type of aerosol-generating system is an electrically operated smoking system. A number of prior art documents, for example U.S. Pat. Nos. 5,060,671, 5,388,594, 5,505,214, 5,591,368, WO-A-2004/043175, EP-A-0 358 002, EP-A-0 295 122, EP-A-1 618 803, EP-A-1 736 065 and WO-A-2007/131449, disclose electrically operated smoking systems, having a number of advantages. One advantage of some examples described is that they can reduce sidestream smoke, while permitting the smoker to selectively suspend and reinitiate smoking.

Handheld electrically operated smoking systems consisting of a device portion comprising a battery and control electronics, and a cartridge portion comprising a supply of aerosol-forming substrate, and an electrically operated vapouriser, are known. A cartridge comprising both a supply of aerosol-forming substrate and a vapouriser is sometimes referred to as a "cartomiser". The cartridge portion typically comprises not only the supply of aerosol-forming substrate and an electrically operated heater assembly, but also a mouthpiece, which the user sucks on in use to draw aerosol into their mouth. The vapouriser is typically a heater assembly for example comprising a coil of heater wire wound around an elongate wick soaked in liquid aerosol-forming substrate. The aerosol-forming substrate may be a solid aerosol-forming substrate, such as a granules or shreds of tobacco-containing material. In some known examples, the aerosol-forming substrate is an aerosol-forming liquid, sometimes referred to as an "e-liquid".

The cartridge may be refillable when the aerosol-forming liquid, or "e-liquid", is consumed. Typically, the e-liquid is formulated prior to purchase by the consumer, with the concentrations of the e-liquid components being determined by the e-liquid manufacturer. It is possible for consumers to buy the components individually and mix the e-liquids themselves. However, although such manual preparation of e-liquids allows a user to customise the e-liquid formulation as desired, it can be difficult and may require specialist equipment due to the nature of the e-liquid components.

It would be desirable to provide a machine for producing an aerosol-forming composition for use in an aerosol-generating system, for example a smoking system, for example an electrically operated aerosol-generating system, such as a handheld electrically operated smoking system.

According to a first aspect of the present invention, there is provided a machine for producing an aerosol-forming composition for use in an aerosol-generating system, the machine comprising: a plurality of reservoirs for containing components of an aerosol-forming composition; a mixing mechanism in communication with the plurality of reservoirs; a controller connected to the mixing mechanism for control thereof; and a user interface connected to the controller for a user to operate the machine, wherein the mixing mechanism is configured to mix selective quantities of components from the plurality of reservoirs according to specified ratios to create an aerosol-forming composition, and wherein the machine further comprises a testing mechanism comprising: a heater assembly for vaporising a test sample of the composition to form an aerosol, and at least one outlet for delivering the aerosol to the user; and a transfer mechanism for delivering the test sample of the aerosol forming composition to the testing mechanism.

Preferably the ratios are specified by the user.

In some examples, the test sample will comprise all or substantially all of the created aerosol-forming composition. In other examples, the test sample will be less than all of the created composition. For example, less than 50%, less than 20%, less than 10% or less than 5% by volume of the created composition may be delivered to the testing mechanism. For example, the created composition may have a volume of about 0.5 ml or more, for example about 2 ml or more. The created composition may have a volume for example less than about 5 ml, for example less than about 3 ml. The test sample may for example be less than about 1 ml, for example less than about 0.5 ml, for example less than about 0.2 ml, for example about 0.1 ml or less, for example about 0.05 ml or less. In some cases, the test sample may include one or more droplets of the composition.

The testing mechanism may vaporise substantially all or less than all of the test sample, in one or more vaporising operations. In some cases, a second or more test samples from the created composition may be delivered to the testing mechanism in two or more delivery operations.

In some examples the composition will comprise a liquid composition. Some or all of the components comprise liquids. In some examples, one or more components may be non-liquid, for example gel. The composition may for example include one or more solid components for example particles or other objects. One or more of the reservoirs may deliver for example a powder component. In an example, the reservoirs dispense a liquid component and a non-liquid component. The non-liquid component may for example dissolve in the liquid component or may be present as a non-liquid in the aerosol-forming composition.

Advantageously, the testing mechanism allows the user to test a sample of the selected composition directly at the machine. The user can then determine if the selected composition produces a desirable aerosol before a larger quantity of the formulation is dispensed. The machine may mix the components automatically to produce the aerosol-forming composition, thus avoiding the need for manual mixing. This may result in a more accurate and repeatable mix.

In certain examples, the testing mechanism may comprise a fixed, reusable heater assembly. Such a heater assembly is intended to be reused by the machine for multiple testing procedures. In such examples, the testing mechanism preferably further comprises a cleaning device, such as a nozzle for spraying fluid under pressure, with which the fixed heater assembly may be cleaned following a testing procedure. This can reduce the possibility of cross-contamination between subsequent testing procedures using the machine by removing portions of test sample which remain on the heater assembly following aerosolisation. This may improve the accuracy of the aerosol produced from the test sample. In other embodiments, the testing mechanism comprises a removable heater assembly.

In example embodiments, the machine comprises a heater supply containing a plurality of heater assemblies for use with the testing mechanism. The heater assemblies may be single use or disposable heater assemblies. The heater supply may comprise one or more cartridges or hoppers containing one or more stacks of heater assemblies. After use, a heater assembly can be removed from the testing mechanism, disposed of, and replaced with a new heater assembly for one or more subsequent testing procedures. With this arrangement, cross-contamination between test samples can be reduced. This may improve the accuracy of the aerosol produced from the test sample. It also allows a heater assembly to be more easily replaced if necessary.

Where the machine further comprises a heater supply containing a plurality of heater assemblies for use with the testing mechanism, the transfer mechanism may be arranged to select a heater assembly from the heater supply for use with the testing mechanism and deliver it to a user, for example for placement in the testing mechanism. The delivered test sample and heater may then be used in an aerosol generating device. In some examples, some or all of the test sample may be transferred to the testing mechanism within the machine. For example, test sample material could be delivered onto a heater, for example a resistive wire, within the machine to produce an aerosol which is then delivered to the user. In examples of the invention, test sample composition may be delivered to a container. Material may be delivered from the container to a heater for production of an aerosol. A heater may be selected for the test process depending on the container used for the test sample composition. In an example, test composition material is applied directly to the heater. For example, the heater may be dipped in the test composition material.

In examples, the transfer mechanism is configured to select a heater assembly from the heater supply, to apply the test sample on one or more surfaces of the heater assembly and to deliver the heater assembly to the testing mechanism. The test sample may be inserted into the testing mechanism by the machine.

The testing mechanism may be arranged to receive a single type of heater assembly. Alternatively, the testing mechanism may be arranged to receive heater assemblies of different types. In such embodiments, the machine may comprise a heater supply containing a plurality of heater assemblies of different types for use with different types of electrically operated aerosol-generating systems. The testing mechanism may be configured to select a heater assembly from the heater supply based on a desired type of aerosol-generating system, for example, the user's own aerosol-generating system. As different types of aerosol-generating system may produce aerosols with different characteristics from the same aerosol-generating composition in some cases, by selecting a heater assembly from the heater supply based on a desired type of aerosol-generating system, the test sample may be vapourised using a heater assembly suitable for the system. For example the heater assembly may be of the same type as that of the user's aerosol-generating system or one which gives similar results. Consequently, the aerosol produced by the testing mechanism may be closer to the aerosol which would be produced by the user's aerosol-generating system from the same formulation, which may give more accurate testing results. The desired type of aerosol-generating system may be determined from a user input via the user interface. Alternatively, or in addition, the machine may include a sensor for determining the desired type of aerosol-generating system automatically, for example via an RFID connection between the machine and the user's aerosol-generating system, or via machine-readable information on the user's aerosol-generating system, or in another way.

The transfer mechanism may be arranged to apply the test sample on one or more surfaces of the heater assembly by any suitable method. For example, the transfer mechanism comprises a transfer head for applying the test sample to the heater assembly by spraying the heater assembly with the test sample, or by dipping the heater assembly into the test sample, or by both spraying and dipping.

The testing mechanism may comprise an aerosol-forming chamber in which the aerosol forms from a super saturated vapour, which aerosol is then carried into the mouth of a user. An air inlet, air outlet and the chamber are preferably arranged so as to define an airflow route from the air inlet to the air outlet via the aerosol-forming chamber, so as to convey the aerosol to the air outlet and into the mouth of a user.

The machine may comprise a plurality of separate units, for example positioned adjacent to each other, each housing one or more components of the machine. In certain embodiments, the machine may comprise a single unit in which all of the components of the machine are housed.

In certain preferred embodiments, the machine comprises a main unit in which the plurality of reservoirs is housed and the testing mechanism comprises a handheld aerosol-generating device that is external to and coupled with the main unit. The aerosol-generating device is preferably electrically operated and includes the heater assembly and the at least one outlet by which aerosol is delivered to the user.

Having a handheld aerosol-generating device that is external to a main unit may improve the ease of use of the testing mechanism by a user.

As used herein, the term "aerosol-generating device" relates to a device that interacts with an aerosol-forming substrate to generate an aerosol. An aerosol-generating device may be a smoking device that interacts with an aerosol-forming substrate to generate an aerosol that is directly inhalable into a user's lungs thorough the user's mouth.

As used herein, the term "aerosol generating system" refers to a combination of an aerosol-generating device and one or more aerosol-generating articles, such as a cartridge or cartomiser comprising a supply of aerosol-forming substrate, for use with the device. An aerosol-generating system may include additional components, such as for example a charging unit for recharging an on-board electric power supply in an electrically operated or electric aerosol-generating device.

The aerosol-generating device may be coupled to the main unit by a flexible cable. With this arrangement, the aerosol-generating device is portable, in that it may be moved independently from the main unit, while still remaining tethered. Preferably, the aerosol-generating device is coupled to the main unit by a flexible electrical wire. In such embodiments, the main unit preferably comprises a power supply for the aerosol-generating device. This allows the aerosol-generating device to operate without an integral power supply, reducing the weight of the device.

The aerosol generating device may be a smoking device and may have a size comparable to a conventional cigar or cigarette. The device may have a total length between approximately 30 mm and approximately 150 mm. The device may have an external diameter between approximately 5 mm and approximately 30 mm, preferably between 10 mm and 20 mm.

The aerosol generating device may comprise a plurality of air inlets. The number and size of the air flow inlets may be chosen to provide a desired resistance to draw through the device. In a smoking device it may be desirable for the resistance to draw (RTD) through the device to be close to the resistance to draw of a conventional cigarette.

Resistance to draw is also known as draft resistance, draw resistance, puff resistance or puffability, and is the pressure required to force air through the full length of the object under test at the rate of 17.5 ml/sec at 22° C. and 760 Torr (101 kPa). It is typically expressed in units of mmH20 and is measured in accordance with ISO 6565:201 1. The aerosol generating device may provide an RTD of between 80 and 120 mmH20. This approximates the RTD of a conventional cigarette.

The aerosol-generating device may comprise one or more adjustable airflow modifiers, such as vanes, inlets or airflow channels, for varying the resistance to draw through the device. The adjustable airflow modifiers may be adjusted manually by a user, for example using an adjustable dial. Alternatively, or in addition, the adjustable airflow modifiers may be adjusted by a controller in the main unit, or by a controller in the aerosol-generating device. In such embodiments, the controller may adjust the airflow modifiers based on an input from the user via the user interface or via a portable device connected to the machine. In some embodiments, the controller adjusts the airflow modifiers automatically to simulate the resistance to draw of a desired type of device.

In certain embodiments, the main unit comprises a docking station for the aerosol-generating device. The docking station may comprise a sensor for detecting if the aerosol-generating device is correctly positioned at the docking station. The sensor is connected to the controller. The controller may be configured to display an error message on a display portion of the user interface, or to prevent operation of the machine, or both, if the sensor detects that the aerosol-generating device is not correctly positioned. The docking station preferably comprises a docking port for receiving the aerosol-generating device. The docking port may comprise a holding means for holding the aerosol-generating device in the correct position in the docking port. For example, the holding means may comprise a complementary shaped recess, or a clip, or other suitable known holding means.

In certain embodiments, the machine further comprises a mouthpiece supply containing a plurality of disposable mouthpieces for removable coupling with the at least one outlet of the testing mechanism. A mouthpiece delivery mechanism may be configured to deliver a disposable mouthpiece from the mouthpiece supply for subsequent coupling to the at least one output of the testing mechanism. The mouthpiece delivery mechanism may be arranged to deliver the mouthpiece to a mouthpiece supply port based on an instruction from the controller. The mouthpiece can then be removed from the mouthpiece port by a user and coupled to the outlet of the testing mechanism. The machine may also include a mouthpiece disposal port into which used mouthpieces can be placed by a user for disposal after use.

As used herein, the term "mouthpiece" refers to a component that is arranged for placing on or into a user's mouth in order for the user to directly inhale an aerosol generated by the testing mechanism.

The disposable mouthpieces contained in the mouthpiece supply may have an outer diameter which substantially corresponds to the inner diameter of the outlet of the testing mechanism. A mouthpiece from the supply may be removably coupled to the outlet by placing the upstream end of the mouthpiece into the outlet. The at least one outlet and the mouthpieces may be arranged to removably couple to each other via a removable coupling, such as a screw thread, clip, or bayonet or other fitting.

A mixing mechanism is provided to mix the components from the plurality of reservoirs to create an aerosol-forming composition test sample. The ratio of components may for example be specified by the user. In some examples there will be a further step of stirring or agitating the mixture to ensure that the components are combined. Any appropriate mechanism could be used. For example, motion, vibration, stirring or other method could be used. In many examples, however, no such step will be required.

The test sample has a volume of less than the volume of a typical liquid storage container for use in an aerosol-generating device, such as a smoking device. Preferably, the test sample has a volume of less than about 1 ml, preferably about 0.5 ml or less, for example about 0.2 ml or less, preferably from about 0.05 ml to about 0.15 ml, for example about 0.1 ml According to a further aspect of the invention there is provided a machine for producing an aerosol-forming composition for use in an aerosol-generating system, the machine comprising: A plurality of reservoirs for containing components of an aerosol-forming composition; a mixing mechanism in communication with the plurality of reservoirs, a controller connected to the mixing mechanism for control thereof; and a user interface connected to the controller for a user to operate the machine, wherein the mixing mechanism is configured to mix selective quantities of components from the plurality of reservoirs according to specified ratios to create an aerosol-forming composition, and wherein the machine further comprises: a transfer mechanism for delivering a test sample of the aerosol-forming composition to a test cartridge wherein the volume of the test sample is about 0.5 ml or less, preferably from about 0.05 ml to about 0.15 ml.

Thus a test cartridge can be prepared containing a small volume of the aerosol containing composition. The composition in the cartridge can be transferred by the user from the cartridge into their own aerosol generating device, or the cartridge may be used directly with an aerosol generating device, the cartridge providing the composition for vaporisation in the device. For example, the cartridge may form a liquid storage container in the device. The cartridge may further include additional components for example a heater, or liquid storage substrate. The cartridge may further include a liquid transfer substrate, for example for transferring liquid to a heater in the device. For example the cartridge may include a capillary material for example a wick. The composition may be a liquid composition.

In an aspect of the invention, a sample of the aerosol forming composition is delivered to a test cartridge. The sample may comprise only a portion of the prepared aerosol forming composition. For example, the sample may comprise less than 50%, for example less than 20% for example less than 10% of the volume of the prepared composition.

Examples of the present invention allow a user to produce an aerosol-forming composition test sample by specifying the desired ratios of components stored in reservoirs. The selection by the user may be carried out by entering a testing instruction directly via the user interface. For example, the user interface may comprise a touch-sensitive display screen, or a display in combination with a keyboard, keypad, touch-sensitive pad or other similar input device by which the user may manually input the desired quantities of each component.

Alternatively, or in addition, a testing instruction may be entered indirectly by the user via the user interface. For example the user may select a composition, having predefined component ratios, from a list of suggested composition or from a list of compositions associated with the user. For example, the user interface may display e-liquid formulations previously tested by the user. The user interface may display compositions entered by the user using a remote device, for example using a smartphone app, and saved to the user's account. The user interface may display suggested formulations based on ratings given by the user to previously tested samples, or based on previous purchases, or based on ratings given by the user to previous test samples and on previous purchased e-liquids. For example, the suggested e-liquid formulations may be determined by the controller, or by a remote server connected to the machine.

A testing instruction may be entered by the user via a website connected to the controller of the machine, or via a remote device, such as a smart phone, and uploaded to the machine.

The machine may include a sensor for reading—information from a cartridge, container or a part of an aerosol generating system placed in proximity to the sensor. The controller may determine the testing instruction based on the information on the cartridge.

The test sample may comprise a nicotine-containing material. The test sample may comprise a tobacco-containing material. The test sample may comprise volatile tobacco flavour compounds which are released from the composition upon heating. The composition may comprise a non-tobacco material. The composition may for example include water, solvents, ethanol, plant extracts and natural or artificial flavours. The composition may comprise an aerosol former. Examples of suitable aerosol formers are glycerine and propylene glycol.

The plurality of reservoirs each contain a component of an aerosol-forming composition. Two or more of the reservoirs may contain the same component. One or more of the reservoirs may contain a tobacco-containing material comprising volatile tobacco flavour compounds which are released from the composition upon heating. One or more of the reservoirs preferably contains an aerosol former, such as glycerine or propylene glycol. One or more of the reservoirs may contain a component including one or more of water, solvents, ethanol, plant extracts and natural or artificial flavours.

The plurality of reservoirs may contain different liquids.

In examples, the machine comprises at least three reservoirs respectively containing a nicotine source, an aerosol former, and a flavourant.

The machine preferably comprises a memory. The controller may compare ratios in the testing instruction to a range of allowable values stored in the memory to check whether the quantities and proportions component specified in the testing instruction are within predetermined limits. For example, the controller may determine whether the quantity of nicotine specified in the testing instruction exceeds a maximum regulatory limit. Alternatively, or in addition, the controller may determine whether the quantities of one or more of the components specified in the testing instruction exceed a guideline amount stored on the memory and inform the user, for example via an audio signal or a warning message on the user interface. For example, the controller may determine whether the quantity of glycerin exceeds a guideline amount, since this may impair correct functioning of an aerosol-generating device in which the resulting composition is intended for use. Alternatively, or in addition, the controller may determine whether the quantities of one or more components specified in the testing instruction would lead to an undesirable flavour or flavour combination.

The controller may be configured to require a user to enter user age information via the user interface and to prevent operation of the machine if the user age information is not valid, for example if it is less than a regulatory minimum age.

The machine may be connected to a remote server. The controller may be configured to communicate with the remote server to request the offsite manufacture and subsequent delivery of one or more compositions, for example in storage containers or cartridges for an aerosol-generating device. The containers or cartridges may be filled with the aerosol-forming formulation tested by the machine.

Where the machine is connected to a remote server, the remote server preferably includes a database containing formulations previously tested or previously purchased by a user. The machine may then facilitate the user in ordering those formulations at the machine. A database containing formulations previously tested or previously purchased by a user may be stored on a memory provided in the machine. The user interface may be arranged to display such formulations stored on the database for selection by the user. The machine, or a remote server connected to the machine, may be arranged to communicate with a remote device, such as a smartphone, to display the formulations on the remote device for selection by the user. The controller may be configured to communicate with a remote server to request the offsite manufacture and subsequent delivery of one or more units filled with a particular formulation selected from the database. Alternatively, or in addition, the machine may be arranged to prepare and dispense a composition, to fill an empty unit, or provide a new one for use in an aerosol-generating system, based on a user's selection from the database.

The controller may be connected to a remote server to allow a user to share formulations with others, for example by publishing a particular formulation on a social media network associated with the user. Alternatively, or in addition, the machine, or a remote server connected to the machine, may be arranged to communicate with a remote device, such as a smartphone, to allow a user to share formulations with others, for example by publishing a particular formulation on a social media network associated with the user.

Identification information may be associated with a particular composition. Such identification information may be applied directly to a product containing the composition for example by printing or other application method. The identification information may include data regarding the components present in the composition or the proportion of components in the composition. In some examples it will be preferable for the identification information not to include data directly identifying the components and their proportion in the composition. A system may store a library of identification information, the system further including a library of composition data corresponding to the identification information and relating to the presence of particular components in the composition or their % content. The identification information may include coded data about the composition. The system is able to unlock the coded data to determine features of the composition. For example the identification may include an alphanumeric sequence, bar code, QR code.

The machine may be further arranged to prepare and dispense an aerosol-forming composition, to fill into a container, for example an empty container of a cartridge, for use in an aerosol-generating system. In such embodiments, the machine preferably comprises a dispensing port to receive a fresh cartridge and a dispensing mechanism connected to the controller and in communication with the mixing mechanism. The mixing mechanism is configured to mix selective quantities of components from the plurality of reservoirs according to specified ratios to create an aerosol forming composition for filling into the cartridge. The dispensing mechanism is configured to fill into the empty cartridge.

In some examples, the cartridge is preferably a fresh unused cartridge. In other examples, the cartridge may have been previously used. The cartridge may be refilled. Preferably a cleaning step is carried out on the used cartridge before filling.

In any of the aspects of the invention and examples described herein, the cartridge comprises a liquid storage container and may further comprise components of an aerosol forming device. For example the cartridge may further include a heater. The cartridge may further include a liquid storage substrate. The cartridge may further include a liquid transfer substrate, for example for transferring liquid from the liquid storage container to the heater.

The user may manually place the cartridge to be filled in the dispensing port. In other embodiments, the machine further comprises a cartridge supply with a plurality of unfilled cartridges and a delivery mechanism for delivering an unfilled cartridge to the dispensing port for filling.

The cartridge supply may contain a plurality of unfilled cartridges of the same type. Alternatively, the cartridge supply may contain a plurality of unfilled cartridges of different types for use with different types of aerosol-generating systems, the transfer mechanism being configured to select a cartridge of a particular type from the cartridge supply based on a desired type of aerosol-generating system. The desired type of aerosol-generating system may be determined from a user input via the user interface. The machine may include a sensor for determining the desired type of aerosol-generating system automatically, for example via an RFID connection between the machine and the user's aerosol-generating system, or via machine-readable information on the user's aerosol-generating system.

In any of the embodiments in which the machine comprises a dispensing port and a dispensing mechanism for filling a cartridge received in the dispensing port, the machine preferably includes a cartridge marking mechanism for applying to the cartridge machine-readable information relating to the formulation contained in the cartridge. For example, the marking mechanism may apply the machine-readable formulation by printing the information onto a label on the cartridge, by applying a printed label on to the cartridge, or by applying an RFID tag to the cartridge, or by any other suitable method.

In any of the above embodiments, the machine may comprise a main unit having a housing in which the plurality of reservoirs is held. One or more other components of the machine may also be housed within the housing of the main unit. For example, the mixing mechanism, the controller and the transfer mechanism may all be housed within the housing of the main unit, with the user interface being accessible at an outer surface of the housing.

According to a further aspect of the present invention, there is provided a method or producing an aerosol-forming composition for use in an aerosol-generating system, the method comprising the steps of: receiving a test sample instruction via a user interface connected to a controller, the controller actuating a mixing mechanism in communication with a plurality of reservoirs containing components of an aerosol-forming composition; creating an aerosol-forming composition by mixing selective quantities of components from the plurality of reservoirs according to ratios specified by the test sample instruction; delivering a test sample to a testing mechanism comprising a heater assembly and at least one outlet; vaporising the test sample using the heater assembly to form an aerosol; and delivering the aerosol to a user via the at least one outlet.

In certain embodiments, the method further comprises the step of actuating a mouthpiece delivery mechanism to deliver a mouthpiece from a mouthpiece supply for subsequent coupling to the at least one outlet of the testing mechanism. The mouthpiece may be disposable.

Preferably, the step of delivering the test sample to the testing mechanism comprises actuating a transfer mechanism to select a heater assembly from a heater supply, applying the test sample on one or more surfaces of the heater assembly, and delivering the heater assembly to the testing mechanism.

The heater supply may contain a plurality of heater assemblies of different types for use with different types of aerosol-generating systems, and the step of delivering the test sample to the testing mechanism comprises receiving a heater type instruction and actuating the transfer mechanism to select a heater assembly of a particular type from the heater supply based on the heater type instruction.

In certain embodiments, the method further comprises the steps of receiving a dispensing instruction via the user interface; creating an aerosol-forming composition for filling a cartridge for use in an aerosol-generating system by mixing selective quantities of components from the plurality of reservoirs according to ratios specified by the dispensing instruction; and actuating a dispensing mechanism to dispense the aerosol-forming composition to a dispensing port and into a cartridge held in the dispensing port.

Preferably, the method further comprises the steps of actuating a cartridge delivery mechanism to deliver an unfilled cartridge from a cartridge supply to the dispensing port and actuating the dispensing mechanism to dispense the aerosol-forming composition into the cartridge.

Preferably, the aerosol-forming composition test sample has a volume of less than about 0.5 ml, for example less than about 0.3 ml, for example less than about 0.2 ml, for example more than about 0.05 ml. In examples, the volume may be about 0.1 ml. The volume of the text sample may be for example sufficient for about 1 to 50 puffs, preferably 5 to 30 puffs, preferably 10 to 20 puffs to be generated from the sample, for example in the aerosol generating system.

According to a further aspect of the invention there is provide a method for producing a test sample of an aerosol-forming composition for use in an aerosol-generating system, the method comprising the steps of: receiving a testing instruction via a user interface connected to a controller, the controller actuating a mixing mechanism in communication with a plurality of reservoirs containing components of an aerosol-forming composition; creating an aerosol-forming composition by mixing selective quantities of components from the plurality of reservoirs according to ratios specified by the testing instruction; delivering a test sample comprising the aerosol-forming composition to test cartridge, wherein the volume of the test sample is about 0.5 ml or less, preferably from about 0.05 ml to about 0.15 ml.

The testing mechanism may comprise more than one heater assembly for vapourising the test sample. For example, the testing mechanism may comprise two, or three, or four, or five, or six or more heater assemblies. The heater assembly or heater assemblies may be arranged appropriately so as to most effectively heat the test sample.

The heater assembly preferably comprises a heating element formed from an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, Constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colo. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E. I. du Pont de Nemours and Company, 1007 Market Street, Wilmington, Del. 19898, United States of America.

Alternatively, the heater assembly may comprise an infrared heating element, a photonic source, or an inductive heating element.

The heater assembly may take any suitable form. For example, the heater assembly may take the form of a heating blade. Alternatively, the heater assembly may take the form of a casing or substrate having different electro-conductive portions, or an electrically resistive metallic tube. Alternatively, one or more heating needles or rods that run through the centre of the aerosol-forming substrate may also be suitable. Alternatively, the heater assembly may be a disk (end) heating element or a combination of a disk heating element with heating needles or rods. Alternatively, the heater assembly may comprise a flexible sheet of material arranged to surround or partially surround the test sample. Other alternatives include a heating wire or filament, for example a Ni—Cr, platinum, tungsten or alloy wire, or a heating plate. Optionally, the heater assembly may comprise a heating element deposited in or on a rigid carrier material.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which.

Figure 1:
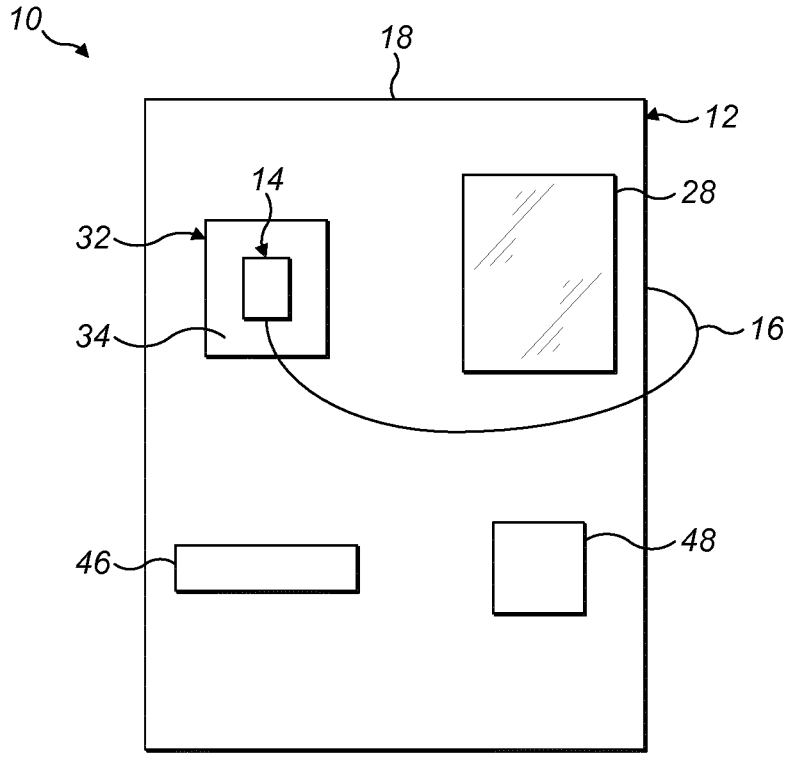
FIG. 1 shows a front view of a machine according to a first embodiment.
Figure 2:
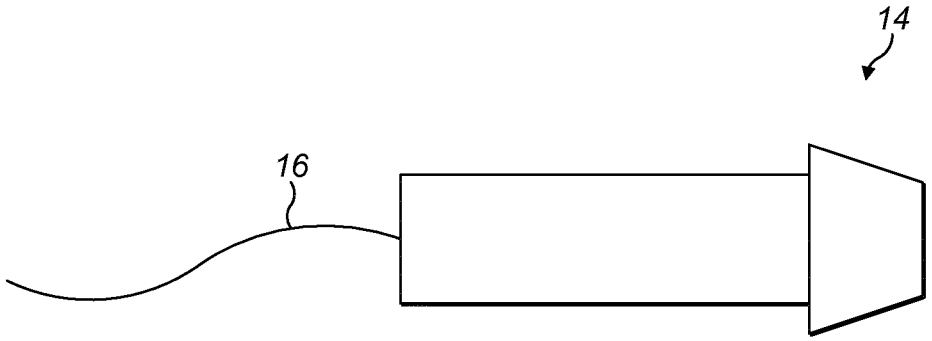
FIG. 2 shows an enlarged view of the testing mechanism of FIG. 1.
Figure 3:
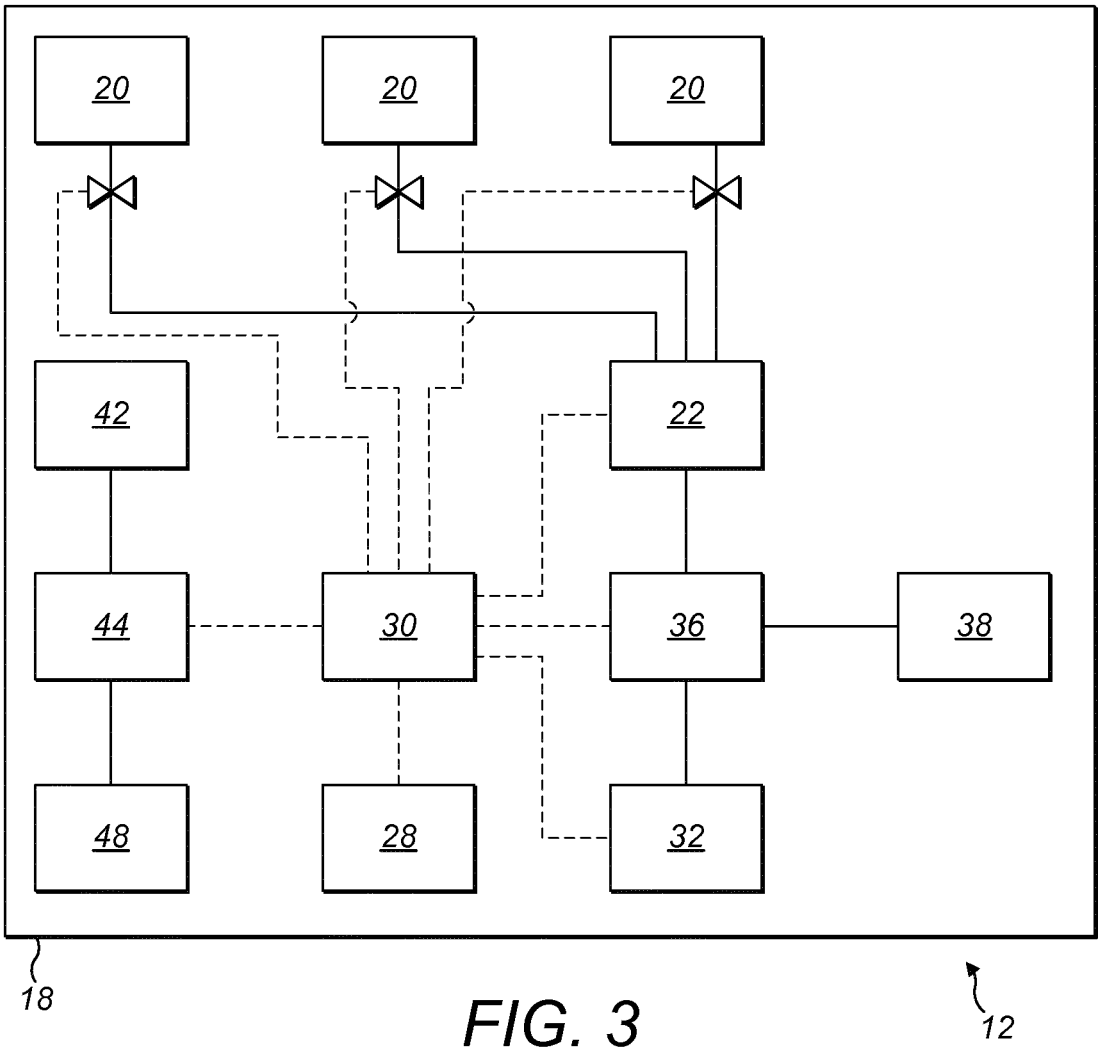
FIG. 3 shows a functional schematic view of the machine of FIG. 1.

Referring to FIGS. 1 to 3, there is shown a machine 10 according to a first embodiment for producing an aerosol-forming liquid for use in an electrically operated aerosol-generating system, such as a smoking system. The machine 10 comprises a main unit 12 and a testing mechanism in the form of a handheld electrically operated aerosol-generating device 14. The aerosol-generating device 14 is external to the main unit 12 and is coupled to the main unit by a flexible electrical cable 16.

The main unit 12 comprises a housing 18 within which is provided a plurality of reservoirs 20. The reservoirs 20 each contain a liquid component of the aerosol-forming liquid. The reservoirs 20 may each contain a different liquid component. Alternatively, the same liquid component may be contained in two or more of the reservoirs 20. In this example, the machine 10 comprises three reservoirs respectively containing nicotine, an aerosol former and a flavourant, although it will be appreciated that the machine may comprise fewer or more reservoirs, for example four, five, six, seven, eight, nine, ten, or more reservoirs containing different liquid components of an aerosol-forming liquid.

The main unit 12 includes a mixing mechanism 22 in fluid communication with each of the reservoirs 20 by supply tubes 24. Each supply tube 24 includes an electrically operated valve 26 to control the flow of the liquid component from the reservoir 20 to the mixing mechanism 22.

The main unit 12 also includes a user interface 28 and a controller 30 connected to the mixing mechanism 22 and to the user interface 28. The user interface 28 is operable by a user to operate the machine, as described below in relation to FIGS. 3 and 4. In this example, the user interface 28 comprises a touch-sensitive display screen, although it could comprise a display in combination with a keyboard, keypad, touch-sensitive pad or other similar input device. The user interface 28 may also comprise a card payment device (not shown), or other payment means for taking payment from a user. The user interface 28 may also comprise a reader (not shown), such as an user-ID card reader or passport reader for verifying a user's age.

The controller 30 is connected to the supply valves 26 and is configured to operate the valves 26 in response to a testing instruction from a user via the user interface 28 to dispense to the mixing mechanism 22 a particular quantity of each liquid component stored in the reservoirs 20 according to the desired ratios specified by the user testing instruction. The mixing mechanism 22 is configured to mix the dispensed quantities of the liquid components to create an aerosol-liquid test sample for transfer to the aerosol-generating device 14.

The main unit 12 includes a docking station 32 having a docking port 34 for receiving the aerosol-generating device. The docking station 32 includes a docking sensor (not shown) operable to detect whether the aerosol-generating device 14 is correctly positioned in the docking port 34. The docking sensor is connected to the controller 30 and the controller 30 is arranged to prevent operation of the machine 10 if the docking sensor detects that the device 14 is not correctly positioned in the docking port 34. The device 14 may be held in the docking port 34 by a releasable coupling, such as a clip. Alternatively, or in addition, the docking port 34 may include a shaped recess arranged to receive and hold at least part of the device 14.

The machine 10 further includes a mouthpiece supply 42 containing a plurality of disposable mouthpieces for use with the aerosol-generating device 14 and a mouthpiece delivery mechanism 44 connected to the controller 30. The mouthpiece delivery mechanism 44 is arranged to remove a mouthpiece from the mouthpiece supply 42 and to deliver the mouthpiece to a mouthpiece supply port 46 provided in the housing of the main unit 12 based on an instruction from the controller 30. The mouthpiece can then be removed from the mouthpiece port 46 by a user and coupled to the aerosol-generating device 14. The main unit 12 also includes a mouthpiece disposal port 48 into which used mouthpieces can be placed by a user for disposal after use.

In this example, the disposable mouthpieces contained in the mouthpiece supply 42 have an outer diameter which corresponds to the inner diameter of the outlet at the downstream end of the aerosol-generating device 14, so that a mouthpiece from the supply can be removably coupled to the outlet by placing the upstream end of the mouthpiece into the outlet. In other examples, each mouthpiece may be arranged to couple to the device 14 via a removable coupling, such as a screw thread, clip, or bayonet fitting.

Figure 4:
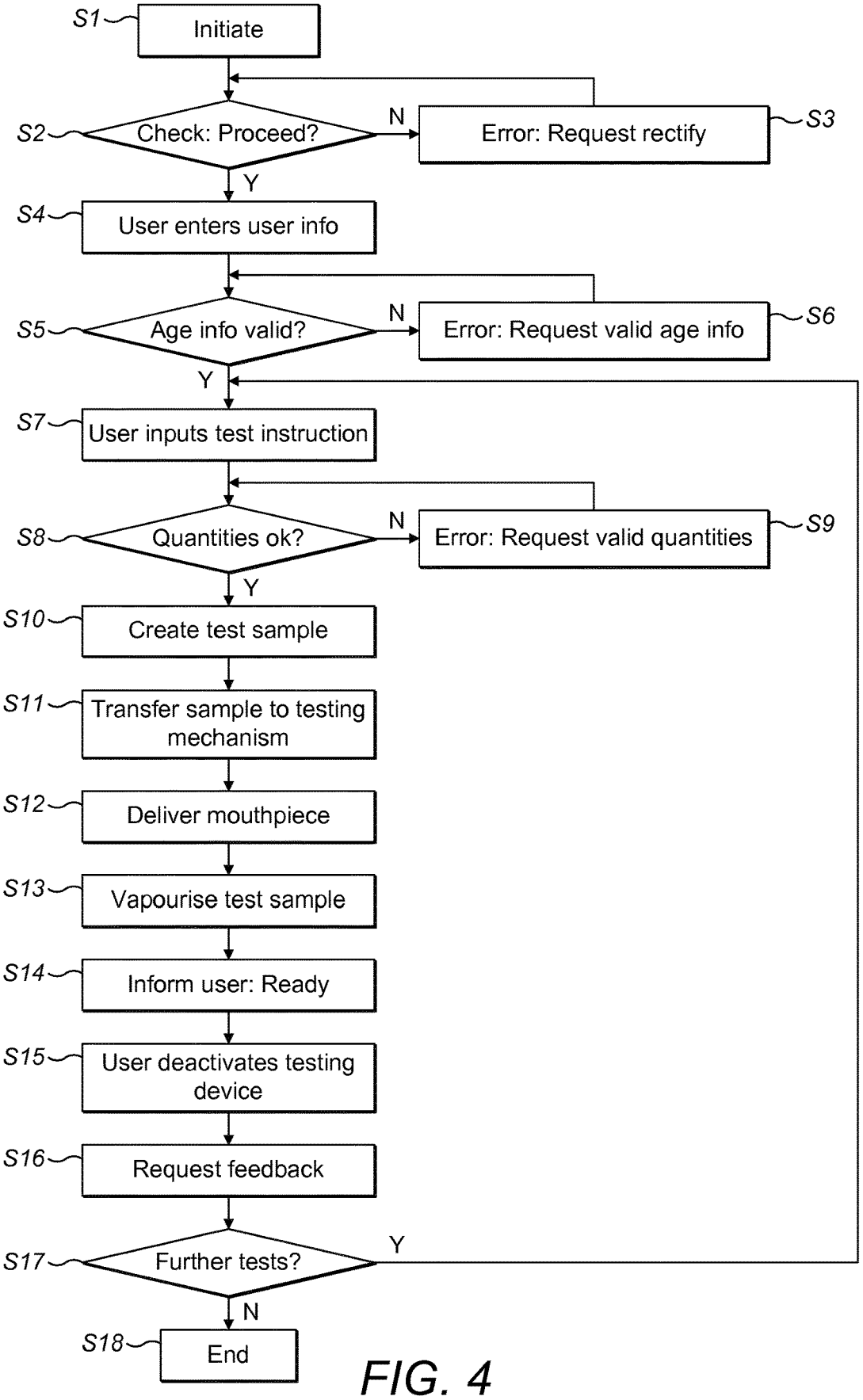
FIG. 4 shows an operational flow chart of the machine of FIG. 1.

FIG. 4 is a flow chart showing the operation of the machine 10.

At step S1, the user uses the user interface to activate the machine 10 and initiate a testing procedure. At step S2, the machine 10 performs a start-up procedure to check that a testing operation can be carried out. For example, during this step, the controller 30 may communicate with the docking sensor to confirm whether the aerosol-generating device 14 is correctly positioned in the docking port 34. The controller 30 may also communicate with sensors associated with the reservoirs 20 to confirm whether sufficient levels of e-liquid component are stored in the reservoirs 20. If the controller 30 determines during the start-up procedure that a testing operation cannot be carried out, an error message is displayed on the user interface 28, at step S3, requesting that the user addresses the reason for the halted testing operation, for example by ensuring that the device 14 is correctly positioned in the docking port 34.

At step S4, the user enters user information, including user age information, via the user interface 28, for example by allowing a reader in the user interface to read a user ID, or by entering the information manually. At step S5, the controller 30 determines whether the user age information is valid. If the user age information is not valid, an error message is displayed on the user interface 28 at step S6 to inform the user that the testing procedure will not proceed without valid user age information.

At step S7, the user uses the user interface to input a testing instruction. The testing instruction specifies the desired ratios of each of the liquid components of the aerosol-forming liquid which are stored in the reservoirs 20. The testing instruction may be entered directly by the user via the user interface 28, for example as described below in relation to FIG. 5. Alternatively, the testing instruction can be entered indirectly by the user via the user interface 28 by selecting an e-liquid mix, with predefined component ratios, from a list of suggested mixes or from a list of e-liquid mixes associated with the user. For example, the user interface 28 may display e-liquid formulations previously tested by the user, or previously entered by the user using a remote device and saved to the user's account. As a further alternative, the machine 10 may include a cartridge sensor for reading e-liquid formulation information from a cartridge placed in close proximity to the cartridge sensor by the user, the controller determining the testing instruction based on the e-liquid formulation information on the cartridge.

At step S8, the controller 30 determines whether the quantities of liquid component specified in the testing instruction are within predetermined limits stored on the memory. For example, the controller 30 may determine whether the quantity of nicotine specified in the testing instruction exceeds a maximum regulatory limit. Alternatively, or in addition, the controller 30 may determine whether the quantities of one or more of the components specified in the testing instruction exceed a guideline amount stored on the memory and display a warning message on the user interface 28 to inform the user. For example, the controller 30 may determine whether the quantity of glycerin exceeds a guideline amount, since too much glycerin may impair correct functioning of an aerosol-generating device in which the resulting liquid is intended for use. Alternatively, or in addition, the controller 30 may determine whether the quantities of one or more e-liquid components specified in the testing instruction would lead to an undesirable flavour or flavour combination. If the quantities of e-liquid component specified in the testing instruction are outside of predetermined limits, or outside of guideline amounts, an error message is displayed on the user interface 28 at step S9 to inform the user and to request confirmation of the testing instruction with quantities of e-liquid components that are within predetermined limits.

At step S10, once the controller 30 has determined that the quantities of e-liquid components specified by the user in the testing instruction are within predetermined limits stored on the memory, the machine 10 creates the e-liquid test sample according to the ratios specified in the testing instruction. During this step, the controller 30 operates the supply valves 26 in response to the testing instruction to dispense the quantity of each e-liquid component specified in the testing instruction from the reservoir 20 in which it is stored to the mixing mechanism 22 via the supply tubes 26 to form the e-liquid test sample.

At step S11, once the e-liquid test sample has been mixed according to the user testing instruction, the controller 30 operates the transfer mechanism 36 to select a disposable heater assembly from the heater supply 38 and to apply the e-liquid test sample onto the selected disposable heater assembly At step S12, the controller 30 actuates the mouthpiece delivery mechanism 44 to select a disposable mouthpiece from the mouthpiece supply 42 and to deliver the selected mouthpiece to the mouthpiece supply port 46.

At step S13, the controller 30 operates the device 14 to heat the heater assembly in order to vapourise the e-liquid test sample applied on the heater assembly to form an aerosol.

As step S14, the controller 30 displays a message on the user interface 28 to inform the user that the test sample has been vapourised and is ready for testing and to instruct the user to remove the mouthpiece from the mouthpiece supply port and to place it on the device 14.

At step S15, once the aerosol has been tested, the user deactivates the testing device 14 via the user interface 28.

At step S16, the controller 30 displays a message on the user interface 28 requesting feedback on the tested aerosol and instructing the user to remove the mouthpiece from the device, dispose of the mouthpiece in the mouthpiece disposal port 48 and to return the device 14 to the docking station 32. The controller 30 then saves the e-liquid formulation and feedback information to the user's registered account and displays a message, at step S17, asking the user whether further testing operations are required. If further testing operations are required, the controller returns to step S7 and requests that the user enters a testing instruction via the user interface 28. If no further testing operations are required, the procedure ends at step S18.

In some examples the volume of the composition formed in the mixing mechanism 22 from the components delivered from the reservoirs is greater than is required for the test sample. In this case, only a portion of the composition is delivered to the testing mechanism. The remaining composition not delivered to the testing mechanism may be later dispensed into a cartridge, for example if the user decides to purchase that composition. The remaining composition not delivered to the testing mechanism may be held in the machine, either in the mixing mechanism 22 or in a separate storage unit, and may be dispensed to a subsequent user for example as a test sample or in a cartridge.

In a further example of an aspect of the invention, a test sample of the composition is delivered from the mixing mechanism 22 to a test cartridge. The volume of liquid delivered to the test cartridge may be for example less than about 0.5 ml, for example about 0.1 ml. The cartridge may comprise a liquid storage container. In other examples, the cartridge may include other components for example a heater and optionally a liquid transfer substrate for transferring liquid from the liquid storage container to the heater. In some examples, the cartridge comprises a cartomiser for an e-cigarette device. The cartridge may for example be a low-volume cartomiser which the user may use in combination with their own e-cigarette system to try a new composition. The machine for filling the test cartridge may include one or more of the features described below in relation to FIGS. 6 and 7.

Figure 5:
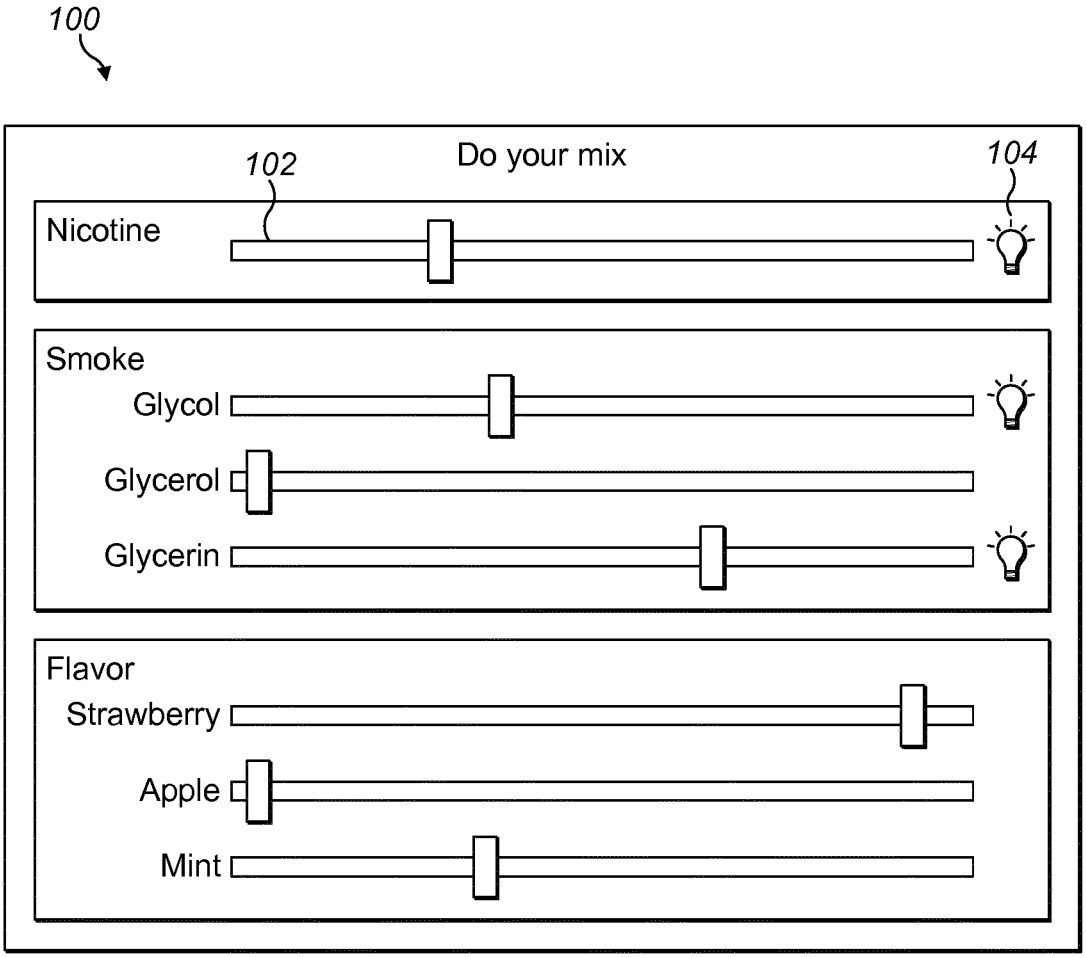
FIG. 5 shows an example selection screen for display on the user interface of the machine of FIG. 1.

FIG. 5 is an example selection screen 100 for display on the user interface 28 by which user may select mix ratios and thereby input a testing instruction. The selection screen 100 includes a slider bar 102 for each e-liquid component stored in the reservoirs 20. The user can then increase the quantity of a particular e-liquid component by sliding the respective slider bar 102 towards the right. The selection screen 100 also includes warning indicators 104 for one or more of the e-liquid components. In this example, the warning indicators 104 are each in the form of a light bulb. The warning indicator 104 for a particular e-liquid component can be illuminated by the controller 30 if the quantity of that component specified by the user is outside of a predetermined limit to provide a warning to the user.

Figure 6:
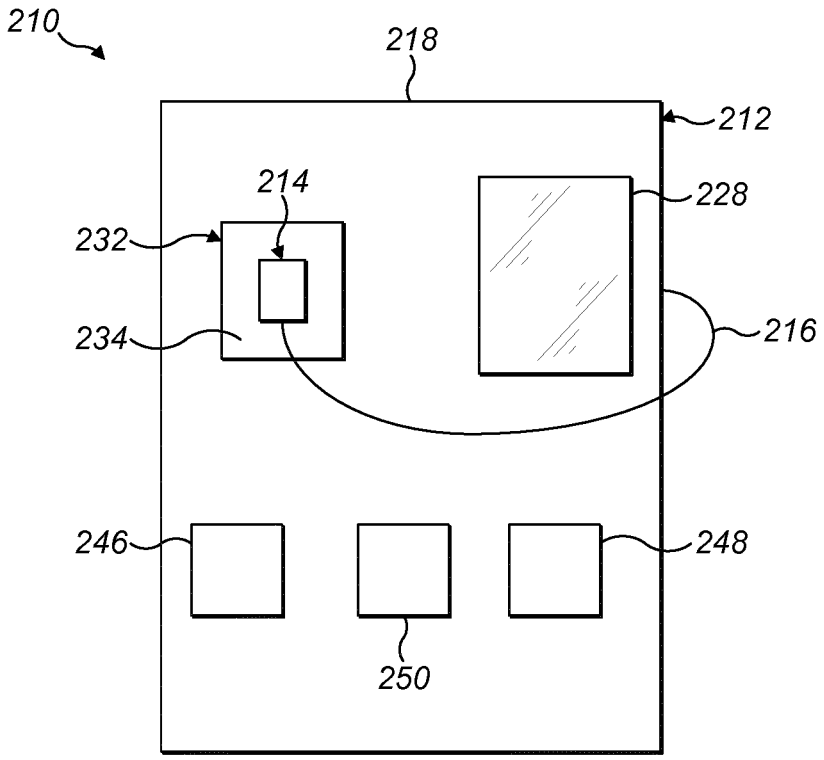
FIG. 6 shows a front view of a machine according to a second embodiment.
Figure 7:
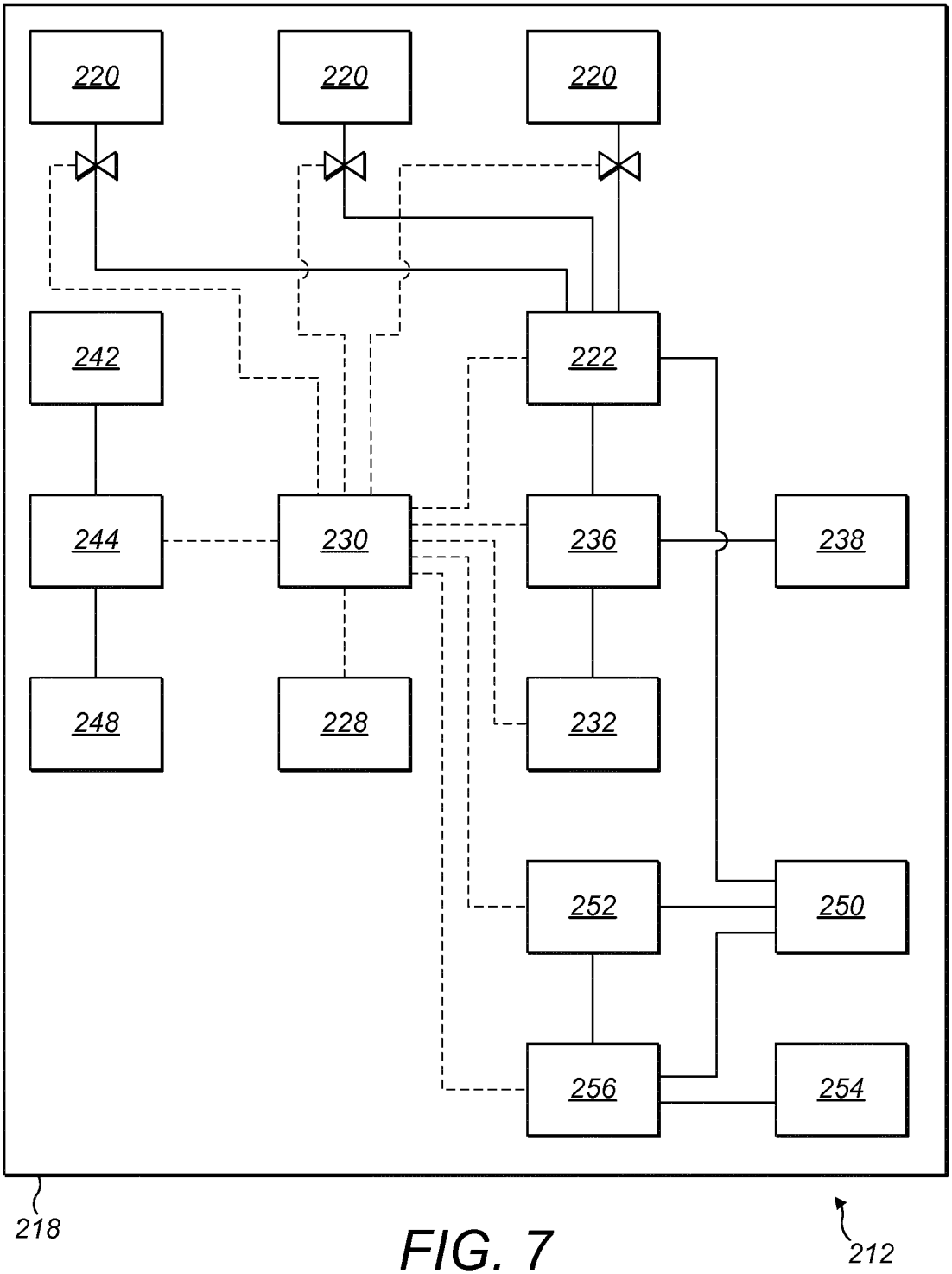
FIG. 7 shows a functional schematic view of the machine of FIG. 6.

Referring to FIGS. 6 and 7, there is shown a machine 210 according to a further embodiment. The machine 210 is substantially the same as the machine 10 according to the first embodiment, as described above in relation to FIGS. 1 to 3, with the exception that the machine 210 is further arranged to prepare and dispense an aerosol-forming liquid, or e-liquid, to fill an empty cartridge for use in an aerosol-generating system. In the below description, like reference numerals have been used to designate those parts in common with the machine 10 shown in FIGS. 1 to 3.

In addition to the components discussed above in relation to the machine 10 according to the first embodiment, the main unit 212 of the machine 210 further includes a dispensing port 250 configured to receive an e-liquid cartridge and a dispensing mechanism 252 associated with the dispensing port 250 and connected to the controller 230. The dispensing mechanism 252 is in fluid communication with the mixing mechanism 222, via a dispensing tube 253 and is configured to fill a cartridge received in the dispensing port 250 with e-liquid mixed by the mixing mechanism 222.

The machine 210 further includes a cartridge supply 254, containing a plurality of cartridges for use with one or more types of aerosol-generating device, and a cartridge delivery mechanism 256 connected to the controller 230. The cartridge delivery mechanism 256 is arranged to select and remove a cartridge from the cartridge supply 254 and to deliver the selected cartridge to the dispensing port 250 for subsequent filling by the dispensing mechanism 252. The machine may also include a cartridge marking mechanism (not shown) for applying machine-readable e-liquid formulation information to the cartridge, either by printing the information onto a label on the cartridge, by applying a printed label on to the cartridge, or by applying an RFID tag to the cartridge.

Figure 8:
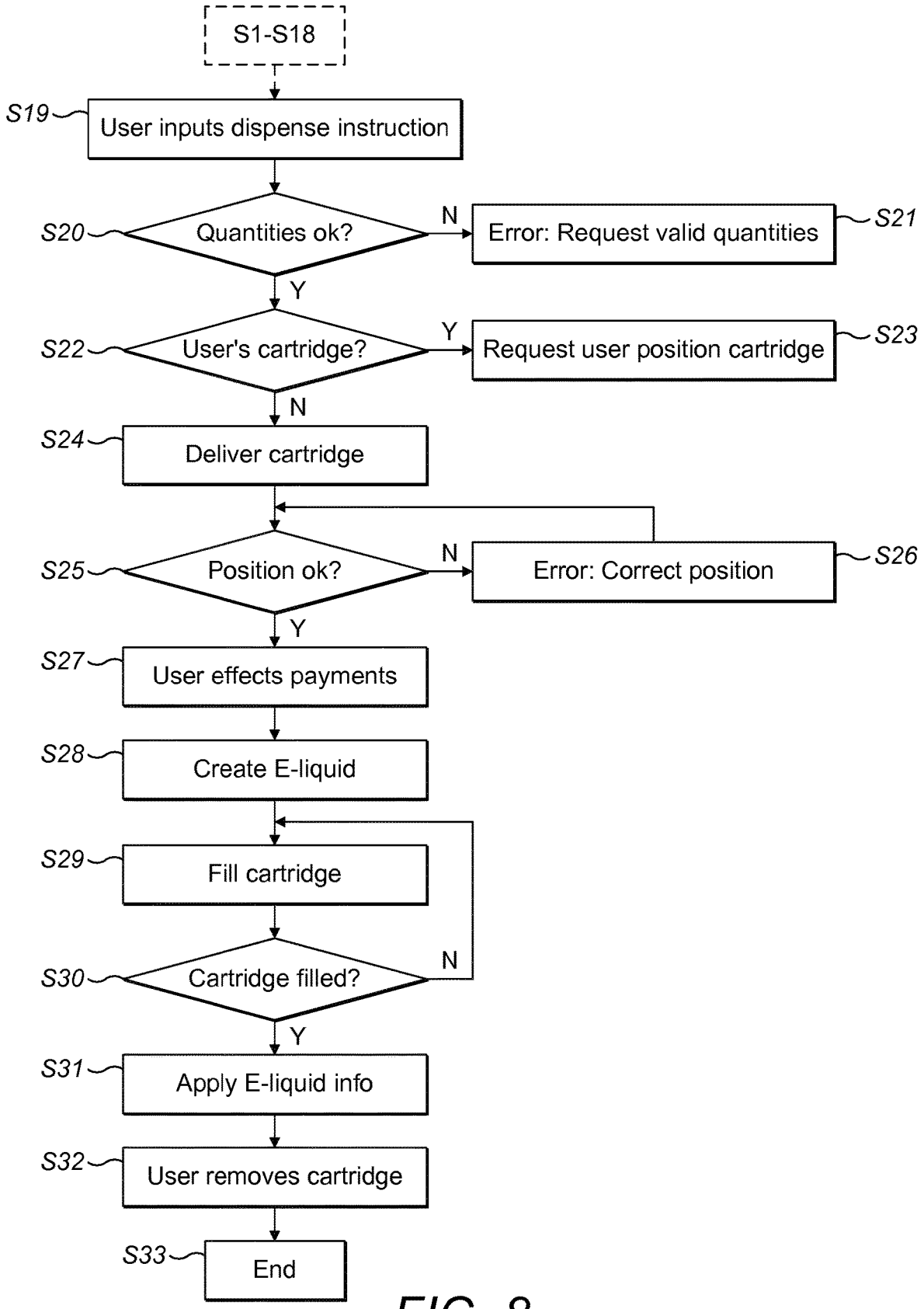
FIG. 8 shows an operational flow chart of the machine of FIG. 6.

FIG. 8 is a flow chart showing the operation of the machine 210.

Steps S1-S18 (not shown), which relate to the testing procedure, are the same as described above in relation to FIG. 4.

At step S19, the user initiates an e-liquid dispensing operation by inputting a dispensing instruction via the user interface 28. The dispensing instruction specifies the desired ratios of each of the e-liquid components stored in the reservoirs 220 and the type of cartridge which is to be filled by the dispensing operation. The dispensing instruction may be entered directly by the user via the user interface 228, for example as described above in relation to FIGS. 4 and 5. Alternatively, the user may enter the dispensing instruction indirectly via the user interface 228 by selecting the e-liquid formulation tested during steps S1-S18, or by selecting an e-liquid mix from a list of suggested mixes or from a list of e-liquid mixes associated with the user. For example, the user interface 228 may display e-liquid formulations previously tested by the user, or previously entered by the user using a remote device and saved to the user's account. As a further alternative, the machine 210 may include a cartridge sensor for reading e-liquid formulation information from a cartridge placed in close proximity to the cartridge sensor by the user, the controller determining the dispensing instruction based on the e-liquid formulation information on the cartridge.

At step S20, the controller 230 determines whether the quantities of e-liquid component specified in the dispensing instruction are within predetermined limits stored on the memory in the same way as described above in relation to step S8 in FIG. 4. If the quantities of e-liquid component specified in the dispensing instruction are outside of predetermined limits, or outside of guideline amounts, an error message is displayed on the user interface 228 at step S21 to inform the user and to request confirmation or revision of the dispensing instruction so that the specified quantities of e-liquid components are within predetermined limits.

At step S22, the controller 230 queries whether the user has their own cartridge to be refilled, or requires a new cartridge to be provided by the machine 210. If the user has their own cartridge to be refilled, the controller 230, via the user interface 228, requests that the user places the cartridge to be refilled into the dispensing port, at step S23. If a new cartridge is required, the controller 230 operates the cartridge delivery mechanism 256 at step S24 to select and remove a cartridge from the cartridge supply 254 and to deliver the selected cartridge to the dispensing port 250 for subsequent filling by the dispensing mechanism 252.

At step S25, the controller 230 checks whether the cartridge to be filled is correctly placed in the dispensing port 250 using one or more sensors (not shown) associated with the dispensing port 250. If the cartridge is not correctly positioned in the dispensing port 250, the controller 230 displays an error message on the user interface 228 at step S26 requesting the user to correctly place the cartridge in the dispensing port 250. This repeats until the controller 230 determines that the cartridge has been correctly positioned in the dispensing port 250.

At step S27, the user operates the user interface 228 to effect payment for dispensing the selected e-liquid. If a new cartridge is required, the payment required may be more than if the user supplies their own cartridge.

At step S28, the machine 210 creates the e-liquid for filling the cartridge according to the ratios specified in the dispensing instruction. During this step, the controller 230 operates the supply valves 226 in response to the dispensing instruction to dispense the desired quantity of each e-liquid component from the reservoir 220 in which it is stored to the mixing mechanism 222 via the supply tubes 226. The mixing mechanism 222 then mixes together the e-liquid components to form the selected e-liquid.

At step S29, the dispensing mechanism 252 withdraws the e-liquid from the mixing mechanism 222 via the dispensing tube 253 and dispenses the e-liquid into the cartridge received in the dispensing port 250 to fill the cartridge.

At step S30, the machine 210 determines whether the cartridge has been filled with the e-liquid, either by detecting when a predetermined volume of e-liquid has been dispensed by the dispensing mechanism 252 or by detecting the e-liquid level within the cartridge.

At step S31, after the cartridge has been filled, the controller 230 operates the cartridge marking mechanism to apply e-liquid formulation information to the cartridge, either by printing the information onto a label on the cartridge, by applying a printed label on to the cartridge, or by applying an RFID tag to the cartridge.

The controller 230 then displays an end message on the user interface 228, at step S32, indicating that the user may remove the filled cartridge from the dispensing port 250.

The dispensing operation ends at step S33.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. A machine for producing an aerosol-forming composition for an aerosol-generating system, the machine comprising:

a main housing and a handheld electrically-operated aerosol-generating device, the main housing comprising a housing containing:

a plurality of reservoirs configured to contain components of an aerosol-forming composition;

a mixer in communication with the plurality of reservoirs, the mixer being configured to mix selective quantities of components from the plurality of reservoirs according to specified ratios to create an aerosol-forming composition:

a controller connected to, and being configured to control, the mixer; and a transfer head configured to deliver a test sample of the aerosol-forming composition to the aerosol-generating device;

the main housing further comprising:

a user interface connected to the controller and being configured for a user to operate the machine; and a docking station for the aerosol-generating device;

the aerosol-generating device comprising:

a heater assembly configured to vaporize the test sample to form an aerosol, the heater assembly comprising a heating element formed from an electrically resistive material;

an aerosol-forming chamber to form an aerosol from the vaporized test sample; and an air inlet and an air outlet, wherein an airflow route is defined from the air inlet to the air outlet via the aerosol-forming chamber for delivering the aerosol to the air outlet, wherein the aerosol-generating device is coupled to the main housing, the coupling providing an electrical connection between the main housing and the aerosol-generating device.

2. The machine according to claim 1, further comprising a heater supply containing a plurality of heater assemblies configured for the aerosol-generating device.

3. The machine according to claim 2, wherein the transfer head is further configured to select a heater assembly from among the plurality of heater assemblies of the heater supply, to apply the aerosol-forming composition on one or more surfaces of the heater assembly, and to deliver the heater assembly to the aerosol-generating device.

4. The machine according to claim 1, wherein the plurality of reservoirs is housed in the main housing.

5. The machine according to claim 1, further comprising:

a mouthpiece supply containing a plurality of mouthpieces configured to removably couple with the at least one outlet of the aerosol-generating device; and a mouthpiece delivery mechanism configured to deliver a mouthpiece from the mouthpiece supply for subsequent coupling to the at least one outlet.

6. The machine according to claim 1, further comprising a dispensing port configured to receive an unfilled cartridge for the aerosol-generating system and a dispensing mechanism connected to the controller and in communication with the mixer, wherein the mixer is further configured to mix the selective quantities of components from the plurality of reservoirs according to the specified ratios to create the aerosol-forming composition for filling into the unfilled cartridge, and wherein the dispensing mechanism is configured to fill into the unfilled cartridge.

7. The machine according to claim 6, further comprising a cartridge supply containing a plurality of unfilled cartridges for the aerosol-generating system and a cartridge delivery mechanism configured to deliver the unfilled cartridge from the cartridge supply to the dispensing port for subsequent filling.

8. The machine according to claim 7, wherein the cartridge supply contains a plurality of cartridges of different types for different types of aerosol-generating systems, and wherein the cartridge delivery mechanism is configured to select a cartridge of a particular type from the cartridge supply based on a desired type of an aerosol-generating system.

9. The machine according to claim 1, wherein the mixer is further configured to mix the selective quantities of components from the plurality of reservoirs to create the aerosol-forming composition test sample having a volume of about 0.5 ml or less.

10. The machine according to claim 1, wherein the mixer is further configured to mix the selective quantities of components from the plurality of reservoirs to create the aerosol-forming composition test sample having a volume of about 0.05 ml to about 0.15 ml.

11. A method for producing an aerosol-forming composition for an aerosol-generating system, the method comprising:

receiving a testing instruction, via a user interface, at a machine for producing an aerosol-forming composition, the machine comprising a main housing and a handheld electrically-operated aerosol-generating device, the main housing comprising a controller connected to the user interface, the controller actuating a mixer in fluid communication with a plurality of reservoirs containing components of an aerosol-forming composition;

creating an aerosol-fonning composition by mixing selective quantities of components from the plurality of reservoirs according to ratios specified by the testing instruction;

delivering a test sample comprising the aerosol-forming composition to, via a transfer head, an aerosol-generating device comprising a heater assembly. an aerosol-forming chamber, an air inlet, and an air outlet, wherein an airflow route is defined from the air inlet to the air outlet via the aerosol-forming chamber for delivering the aerosol to the air outlet, the aerosol-generating device being located at a docking station and being coupled to the main housing, the coupling providing an electrical connection between the main housing and the aerosol-generating device;

vaporizing the test sample using the heater assembly to form an aerosol in the aerosol-forming chamber; and delivering the aerosol to the user via the at least one air outlet.

12. The method according to claim 11, wherein the delivering the test sample to the aerosol-generating device comprises actuating the transfer head to select a heater assembly from a heater supply, applying the test sample on one or more surfaces of the heater assembly, and delivering the heater assembly to the aerosol-generating device.

13. The method according to claim 11, further comprising:

receiving a dispensing instruction via the user interface;

creating an aerosol-forming composition for filling a cartridge for the aerosol-generating system by mixing the selective quantities of components from the plurality of reservoirs according to the ratios specified by the dispensing instruction; and actuating a dispensing mechanism to dispense the aerosol-forming composition to a dispensing port and into a cartridge held in the dispensing port.

14. The method according to claim 11, wherein the aerosol-forming composition test sample has a volume of from about 0.5 ml or less.

15. The method according to claim 11, wherein the aerosol-forming composition test sample has a volume of from about 0.05 ml to about 0.15 ml.

* * * * *